US006874257B2

(12) United States Patent
Erickson et al.

(10) Patent No.: US 6,874,257 B2
(45) Date of Patent: Apr. 5, 2005

(54) SHOES INCLUDING HEEL CUSHION

(75) Inventors: John J. Erickson, Brockton, MA (US); Douglas K. Robinson, Mansfield, MA (US)

(73) Assignee: Acushnet Company, Fairhaven, MA (US)

( * ) Notice: Subject to any disclaimer, the term of this patent is extended or adjusted under 35 U.S.C. 154(b) by 144 days.

(21) Appl. No.: 10/190,974

(22) Filed: Jul. 8, 2002

(65) Prior Publication Data

US 2003/0131503 A1 Jul. 17, 2003

Related U.S. Application Data

(63) Continuation-in-part of application No. 10/047,320, filed on Jan. 14, 2002.

(51) Int. Cl.[7] ..... A43B 5/00

(52) U.S. Cl. ..... 36/127; 36/103; 36/28; 36/35 R

(58) Field of Search ..... 36/127, 102, 103, 36/25 R, 104, 33, 86, 31, 28, 29, 154, 35 R

(56) References Cited

U.S. PATENT DOCUMENTS

| | | | | |
|---|---|---|---|---|
| 3,550,597 A | | 12/1970 | Coplans | 128/585 |
| 4,608,970 A | | 9/1986 | Marck et al. | 128/80 J |
| 5,243,776 A | | 9/1993 | Zelinko | 36/134 |
| 5,555,584 A | * | 9/1996 | Moore et al. | 36/93 |
| 6,176,025 B1 | * | 1/2001 | Patterson et al. | 36/28 |
| 6,381,875 B2 | * | 5/2002 | Singer et al. | 36/28 |
| 6,516,539 B2 | * | 2/2003 | Nishiwaki et al. | 36/28 |

* cited by examiner

*Primary Examiner*—Ted Kavanaugh

(57) ABSTRACT

The present invention is directed toward a shoe comprising an upper and a sole. The sole has a heel portion that includes an outsole and a gel cushion. Preferably, the heel portion has a cushioning factor of at least about 1.18.

15 Claims, 12 Drawing Sheets

SHOES INCLUDING HEEL CUSHION

CROSS-REFERENCE TO RELATED APPLICATIONS

This application is a continuation-in-part of co-pending U.S. Application Ser. No. 10/047,320, filed Jan. 14, 2002, which is incorporated herein in its entirety by reference.

TECHNICAL FIELD

The present invention is directed to a shoe. More particularly, the present invention is directed to a shoe having an improved outsole that enables greater torsional movement, flexibility and cushion of the shoe.

BACKGROUND OF THE INVENTION

Historically, people first wore shoes to protect their feet. Over the centuries, footwear evolved into many different types that were specific to particular activities. Thus, the protection offered by a cold-weather work boot is highly different from that offered by a running shoe. In addition to protecting the feet, athletic footwear has further developed to offer specific functions dependent on the particular sport. Soccer shoes, for instance, have spikes for traction; whereas cycling shoes have very stiff soles with mounting plates for cleats to engage the pedal. In this manner, golf shoes have evolved to provide the wearer with good traction on grass, comfort while walking, and a stable platform for hitting the ball. Typical golf shoes thus have a relatively stiff sole with metal spikes or plastic cleats.

A stiff sole, while providing a stable platform, can nonetheless cause discomfort because there is a balance between how the foot should be allowed to move versus how it should be supported. An example of this is the fact that during walking and at the start and finish of the golf swing, the foot bends at the metatarsal joints (the ball). Aside from the physical effort needed to flex a very stiff sole (which would tend to cause a 'clunky' gait as when wearing clogs), sole stiffness tends to cause the heel of the foot to slide up and down in the heel cup, potentially causing blisters. Thus, golf shoes have evolved to have soles that flex across the ball area to allow this movement without compromising the lateral stability of a good hitting platform.

Relatively recent studies in biomechanics have sought to better quantify how the 26 bones of the foot move relative to each other during human movements. One particular motion that has been identified is a torsional movement about the long axis of the foot. In effect, the forefoot and rearfoot twist relative to each other. It is thought that this movement smooths the contact between foot and ground, decreasing impacts with the ground as well as providing better ground contact. This observation has led to the development of a golf shoe sole to allow this natural movement.

U.S. Patent No. Re. 33,193, reissued from U.S. Pat. No. 4,608,970, to Marck et al. discloses an orthopedic device for correcting infants' feet. The device includes a posterior part, an anterior part, and a ball-and-socket for allowing three degrees of freedom between the posterior and anterior parts during set-up. These parts are immobilized in a particular position, when the device is in use. As a result, this device does not assist with the natural torsional-like action of the foot in walking where such action is missing.

U.S. Pat. No. 3,550,597 discloses a device that facilitates the natural rolling action of the foot during movement by providing a flat construction with front and rear main lifting sections rigidly connected to a resilient intermediate section that is twisted into the form of a flat torsion spring. The device applies a yieldable torsional action during use that is applied to the foot by the lifting sections, whereby the heel of the foot is urged upwardly at the inner side and the forefoot is raised upwardly at the outer side, producing a torsional action similar to the natural torsion action of the foot.

Another construction intended to provide greater support to the wearer of the shoe is disclosed in U.S. Pat. No. 5,243,776 to Zelinko. The Zelinko golf shoe has a sole having a forward end, a heel end and an intermediate portion joining the two ends. A spike support plate is journaled to a post extending from the forward end of the shoe. The spike support plate is so mounted to the forward end for rotation about a vertical axis. A biasing means, such as tension springs, is provided to connect the spike support plate to the heel end and for constantly biasing the spike support plate to a neutral (i.e., non-rotated) position and returning the support to that position after the support has been rotated. A cover is provided to protect the biasing means. The Zelinko golf shoe is constructed to allow the forward end of a golfer's foot to remain fixed during a golf swing while the heel rotates.

There remains a need for an improved outsole for a shoe that enables individual movements of the foot, particularly, the rotation between the rearfoot and the forefoot. By allowing and controlling these rotations, the outsole would resists torsional instability during play, provides independent traction suspension, and increases the flexibility of the shoe to accommodate the movement of the wearer.

SUMMARY OF THE INVENTION

The present invention is directed toward a shoe comprising an upper and a sole. The sole has a heel portion that comprises an outsole and a gel cushion. Preferably, the heel portion has a cushioning factor of at least about 1.18, more preferably at least about 1.2, and most preferably at least about 1.25.

The gel cushion is situated in a recess within the outsole. The gel cushion is configured and dimensioned to substantially fill the recess. Preferably, the gel cushion has a thickness of at least about 3 mm, more preferably at least about 5 mm, and most preferably at least about 7 mm.

In an alternative embodiment, the gel cushion is sandwiched between a first and a second heel cushions, and the three cushions combine to substantially fill the recess of the outsole. Preferably, both the first and second heel cushions have a thickness of no greater than about 5 mm.

The materials forming the gel cushion are chosen so that the gel cushion has a hardness of no greater than about 25 Shore A, preferably no greater than about 20 Shore A. Suitable materials for the gel cushion are vibration damping viscoelastic materials that comprise triblock copolymers; diblock copolymers; thermoplastic elastomers; thermoplastic olefins; thermoplastic vulcanates; thermoplastic urethanes; vinyl copolymers; polyvinyl acetate and copolymers thereof; acrylics; polyesters; polyurethanes; polyethers; polyamides; polybutadienes; polystyrenes; polyisoprenes; polyethylenes; polyolefins; polyvinyl butyral; epoxy-acrylate interpenetrating networks; natural and synthetic rubbers; silicon rubbers; nitrile rubbers; butyl rubbers; low-density granular materials; piezoelectric ceramics; foamed polymers; ionomers; low-density fiber glass; bitumen; air bladders; liquid bladders; and mixtures thereof.

The viscoelastic material forming the gel cushion may further comprise additives such as fibrous materials, particulate materials, curing agents, crosslinking agents, fillers, colorants, processing aids, antioxidants, foaming agents, blowing agents, plasticizers, and mixtures thereof. When a blowing agent is used, it preferably is added in an amount of at least about 2 percent by weight of the viscoelastic material, preferably from about 4 percent to about 10 percent.

In a preferred embodiment of the invention, the gel cushion comprises a saturated styrene-ethylene/butylene-styrene triblock copolymer and a blowing agent.

In another embodiment, the outsole of the shoe comprises a material that has a hardness of at least about 70 Shore A, preferably at least about 80 Shore A.

In yet another preferred embodiment, a shoe comprises an upper and a sole, the sole has a heel portion that includes a gel cushion substantially encapsulated by an outsole and a midsole. The gel cushion is formed from a viscoelastic material, which provides the heel portion with a cushioning factor of at least about 1.18.

In a further embodiment, a shoe comprises an upper and a sole having a heel portion. The heel portion includes an outsole, and a gel cushion that is formed from a triblock copolymer and a blowing agent; and has a cushioning factor of at least about 1.2.

BRIEF DESCRIPTION OF THE DRAWINGS

To facilitate the understanding of the characteristics of the invention, the following drawings have been provided wherein.

DETAILED DESCRIPTION OF THE PREFERRED EMBODIMENTS

Figure 1:
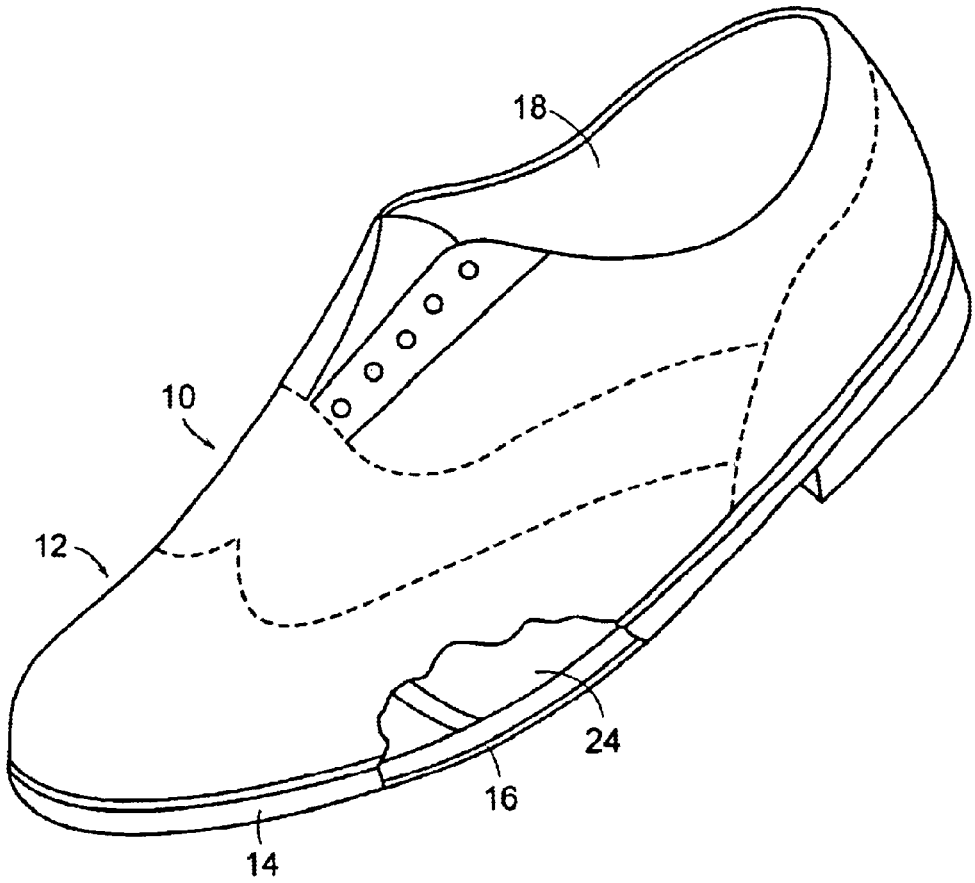
FIG. 1 is a top, perspective view of a golf shoe of the present invention with a portion broken away to expose a midsole.

An embodiment of a golf shoe 10 constructed according to the present invention is shown in FIG. 1. The shoe 10 includes an upper 12, a midsole 14 joined to the upper 12, and an outsole 16 joined to the midsole 14. The upper 12 has a generally conventional shape and is formed from a suitable upper material, such as leather or the like. The top portion of the upper 12 forms an opening 18 to receive a wearer's foot. Upper 12 is preferably secured to midsole 14 with cement or other adhesives using an insole board and conventional techniques, as known by those of ordinary skill in the art.

The midsole 14 provides cushioning to the wearer, and is formed of a material such as an ethylene vinyl acetate copolymer (EVA). Preferably, the midsole 14 is formed on and about the outsole 16. Alternatively, the midsole can be formed separately from the outsole and joined thereto such as by adhesive. Once the midsole and outsole are joined, the outsole 16 forms a substantial portion of the bottom of shoe 10.

Figure 2:
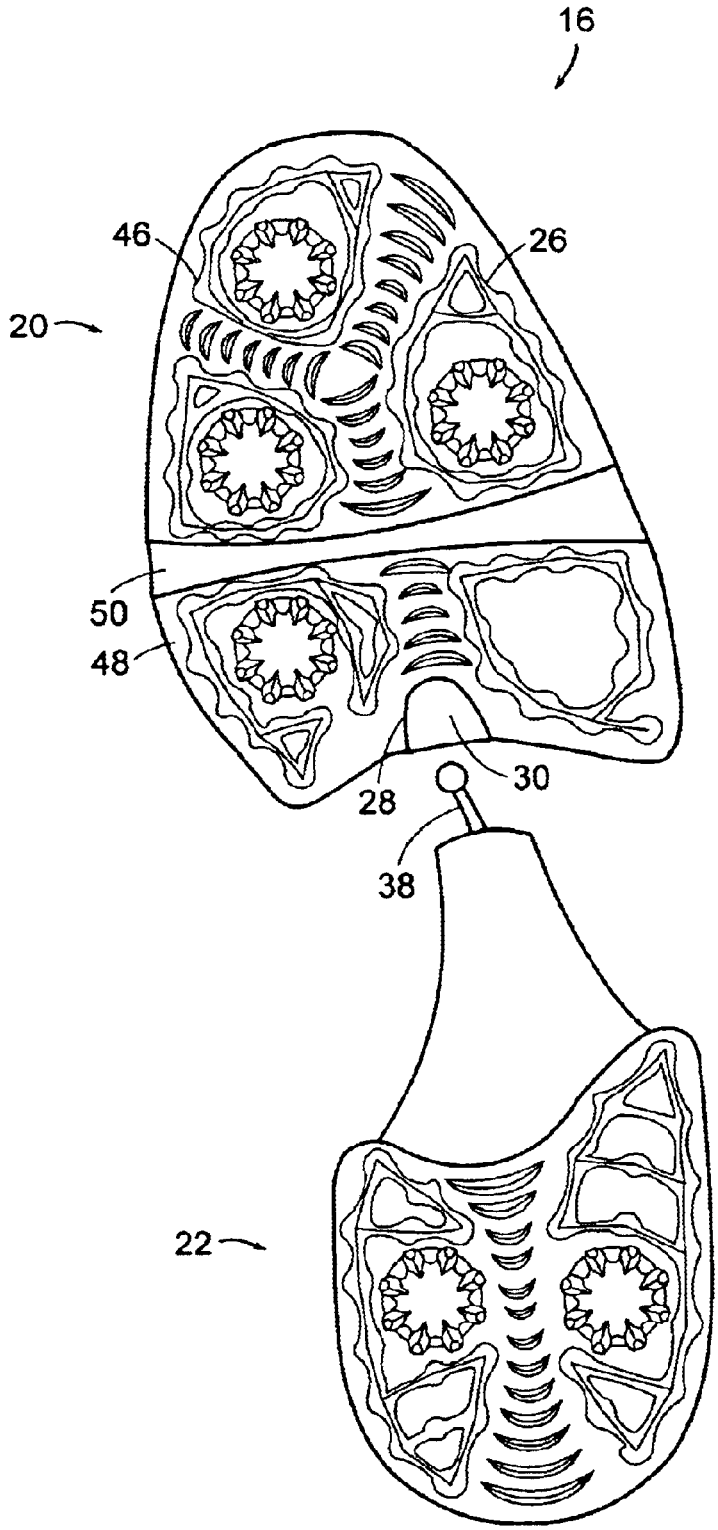
FIG. 2 is an exploded, bottom view of a first embodiment of an outsole of the golf shoe of FIG. 1, wherein a non-metal spike is disassembled therefrom.

Referring to FIG. 2, the outsole 16 includes a forward portion 20 coupled to a separate rearward or shank-heel portion 22. The forward and shank-heel portions 20 and 22 are discrete pieces connected to permit relative movement therebetween. The outsole 16 has a top surface 24 and a bottom surface 26. Midsole 14 is joined to top surface 24. The bottom surface 26 is configured to contact the turf or ground during use.

Figure 3:
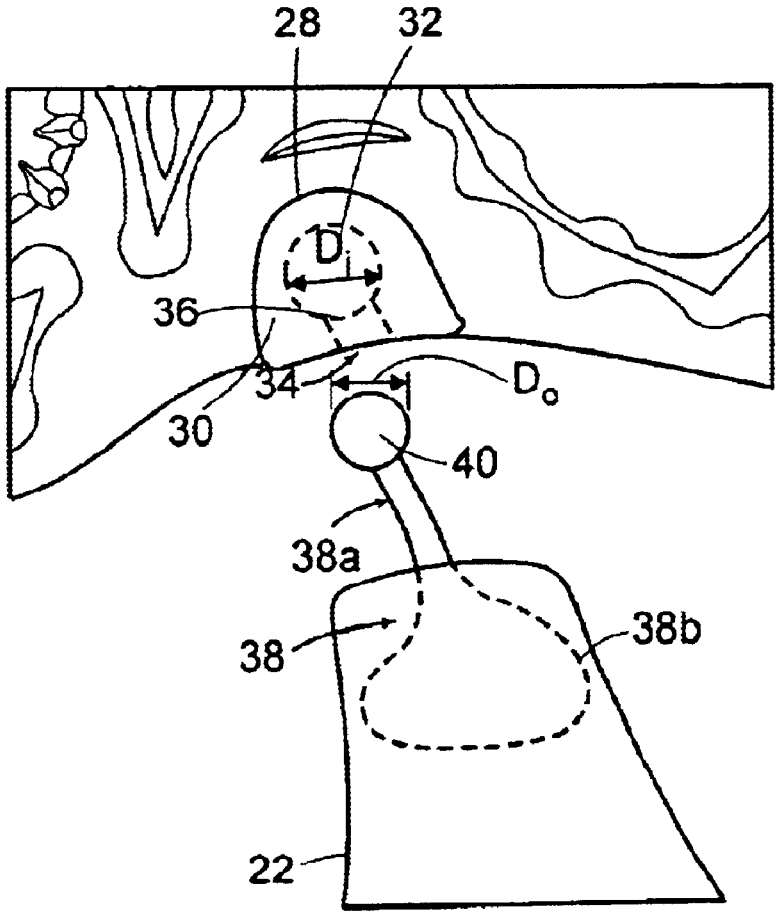
FIG. 3 is an enlarged, bottom view of a portion of the outsole of FIG. 2.

Referring to FIGS. 2 and 3, one preferred mechanism used to couple forward portion 20 to shank-heel portion 22 includes a connector 30 and a male member 38. Connector 30 is positioned at the rearward edge of forward portion 20, and is received in a recess 28 formed in forward portion 20. Preferably, connector 30 has a substantially spherical, interior chamber 32 with an opening 34 and an inner ridge 36. Ridge 36 is preferably spaced from and near the opening 34 within the chamber 32.

Male member 38 extends from the forward edge of shank-heel portion 22 and includes a projection portion 38*a* extending from a base portion 38*b* that is embedded in shank-heel portion 22. In one preferred embodiment, base portion 38*b* is wider than projection 38*a* and may optionally include holes for assuring good molding or adhesion of the male member 38 to shank-heel portion 22.

Figure 4:
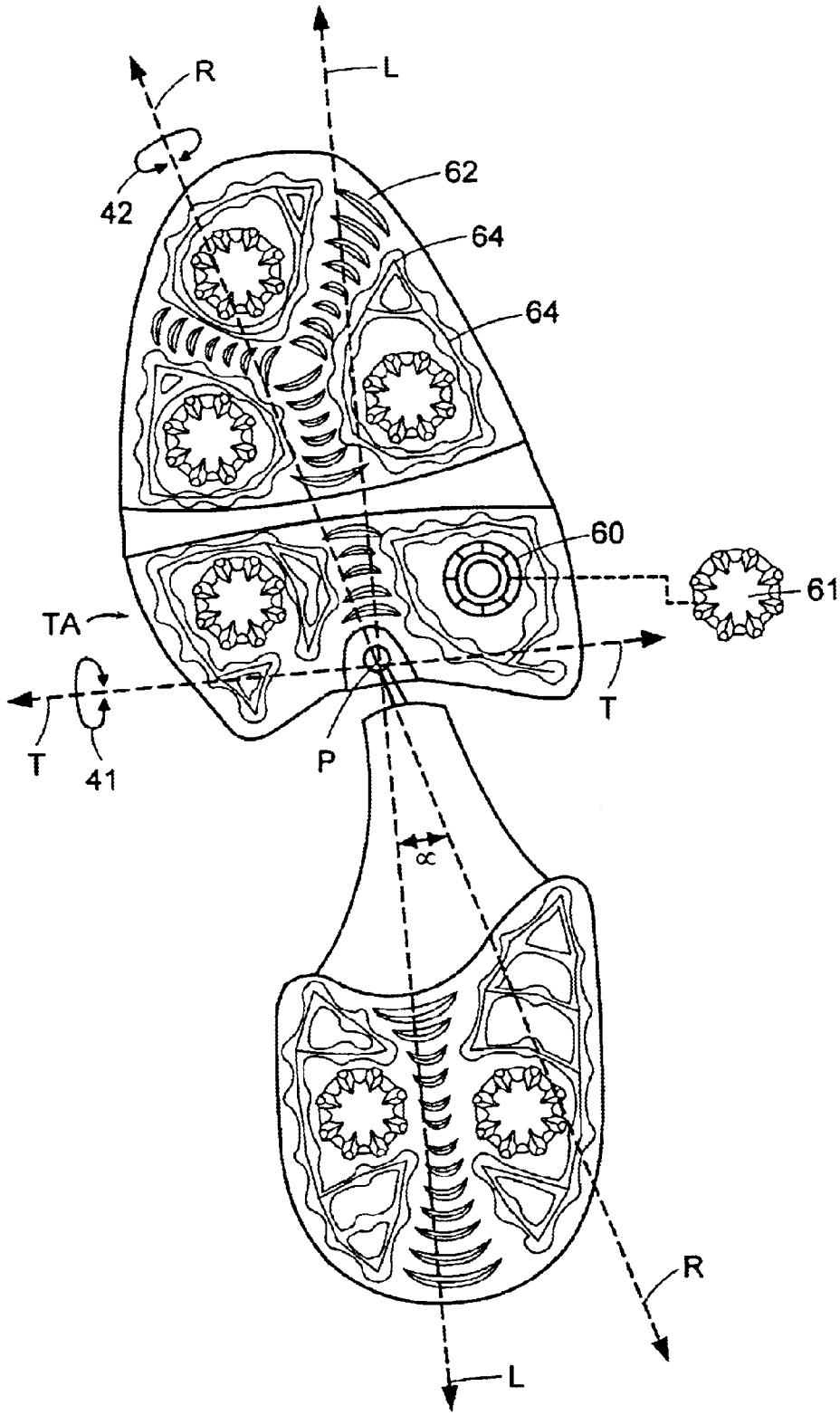
FIG. 4 is a bottom view of the outsole of FIG. 2 according to the present invention, wherein the outsole is assembled and the spike is disassembled therefrom.

The projection portion 38*a* is configured and dimensioned to fit within chamber 32 of connector 30, as shown in FIG. 4. In a preferred embodiment, connector 30 and projection portion 38*a* form a ball-and-socket joint. In this regard, the projection portion 38*a* preferably has a ball 40 at the free end and the spherical chamber 32 serves as the socket. The connector 30 is dimensioned and flexible enough to allow entry of the ball 40 into chamber 32, but also retains the ball 40 within the chamber 32.

The chamber 32, preferably, has an inner diameter $D_1$. The ball 40 preferably has an outer diameter $D_0$. The chamber 32 inner diameter $D_1$ is slightly larger than the ball 40 outer diameter $D_0$ such that there is sufficient clearance to allow the ball 40 to rotate in the socket 32. In a preferred embodiment, the outer diameter $D_0$ of the ball 40 is between about 5 mm and about 6 mm, and most preferably is about 5.5 mm. The inner diameter $D_1$ of the chamber 32 is preferably no more than 0.1 mm greater than the diameter of the outer diameter $D_0$ to allow movement between the two pieces without excessive free play.

In a preferred embodiment, the connector 30 may be formed of flexible plastic material. A suitable material for the connector 30 is an ester-based thermoplastic polyurethane manufactured by URE-TECH CO., Ltd. under the name Utechllan UTY-85A. This material is desirable because it is available as a transparent material so that the ball-and-socket connection is visible from the top and bottom surfaces 24, 26 of the outsole 16. The connector 30 and male member 38 preferably have a hardness of about 90 Shore A.

Figure 6:
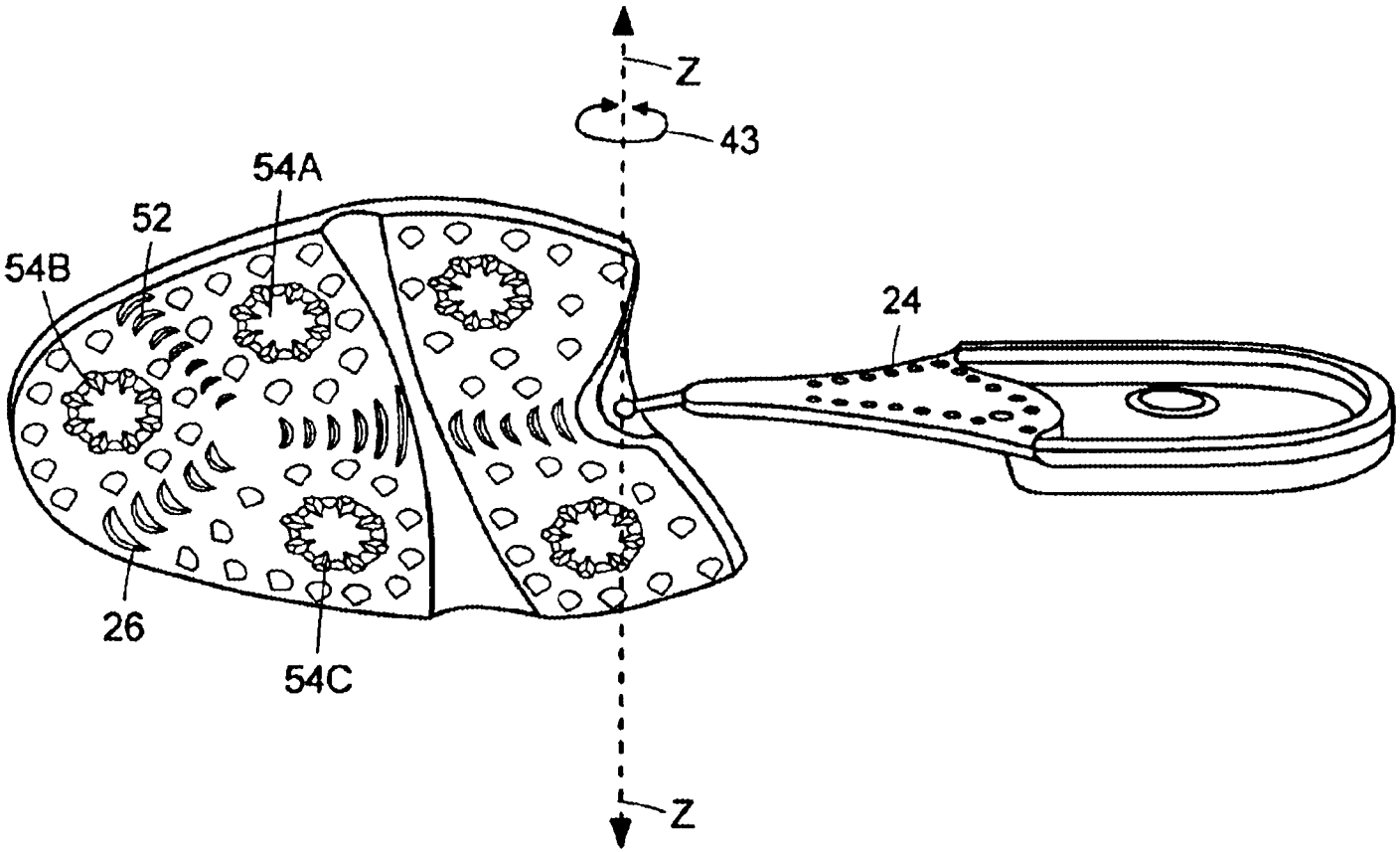
FIG. 6 is a side view of the outsole of FIG. 4 showing the forward portion rotated with respect to the rearward portion.

Referring to FIG. 4, the outsole 16 further includes a longitudinal axis L that extends longitudinally along the center of shank-heel portion 22 through the ball-and-socket connection to the forefoot portion 20 of the outsole 16. A transverse axis T extends transversely across the outsole 16 and through the ball-and-socket connection and is aligned substantially perpendicular to the longitudinal axis L. Referring to FIG. 6, a vertical axis Z extends through the ball-and-socket connection and substantially perpendicular to the bottom surface 26 of the outsole 16 and the longitudinal and transverse axes L and T. Projection portion 38*a* of male member 38 preferably extends along an axis of rotation R that is configured to align with an axis about which the foot naturally rotates during walking and during a golf swing. Projection portion 38*a* and axis R are preferably offset at an angle a of between about 5 degrees and about 30 degrees, most preferably about 15 degrees, with respect to longitudinal axis L.

The ball-and-socket connection defines a pivot point P that is positioned to allow natural rotation between the forefoot and rearfoot during walking and during a golf swing. In a preferred embodiment, the pivot point P is located between the midfoot and forefoot, preferably just behind the transverse arch at the intersection of the subtalar joint axis and the midtarsal. Pivot point P is also preferably located adjacent the exterior of the outsole. The ball-and-socket connection allows the forward and rearward portions 20 and 22 to move independently, pivotally, and relatively with respect to each other about pivot point P. Also, this connection permits relative movement with three degrees of freedom, i.e. rotation about the axes R, T, and Z, while providing a stable connection therebetween. For example, the forward and rearward portions can rotate about axis R (twist) as indicated by arrow 41, rotate about axis T (move upward and downward) as indicated by arrow 42, and rotate about axis Z (move sideways) as indicated by arrow 43 in FIG. 6. Accordingly, torsional management of the outsole 16 is achieved by allowing the shank-heel portion 22 to move independently of the forefoot portion 20 and thereby minimizing any strain that may be caused when the rolling motion of the wearer's foot is constrained by the shoe while walking or swinging a club. Additionally, the coupled connection provided by the ball-and-socket supports the wearer's foot, further providing comfort thereto. Advantageously, a golfer can keep more of the shoe sole on the ground during a golf swing by not having the heel portion of the shoe torque or lift the forefoot up off the turf.

Figure 5:
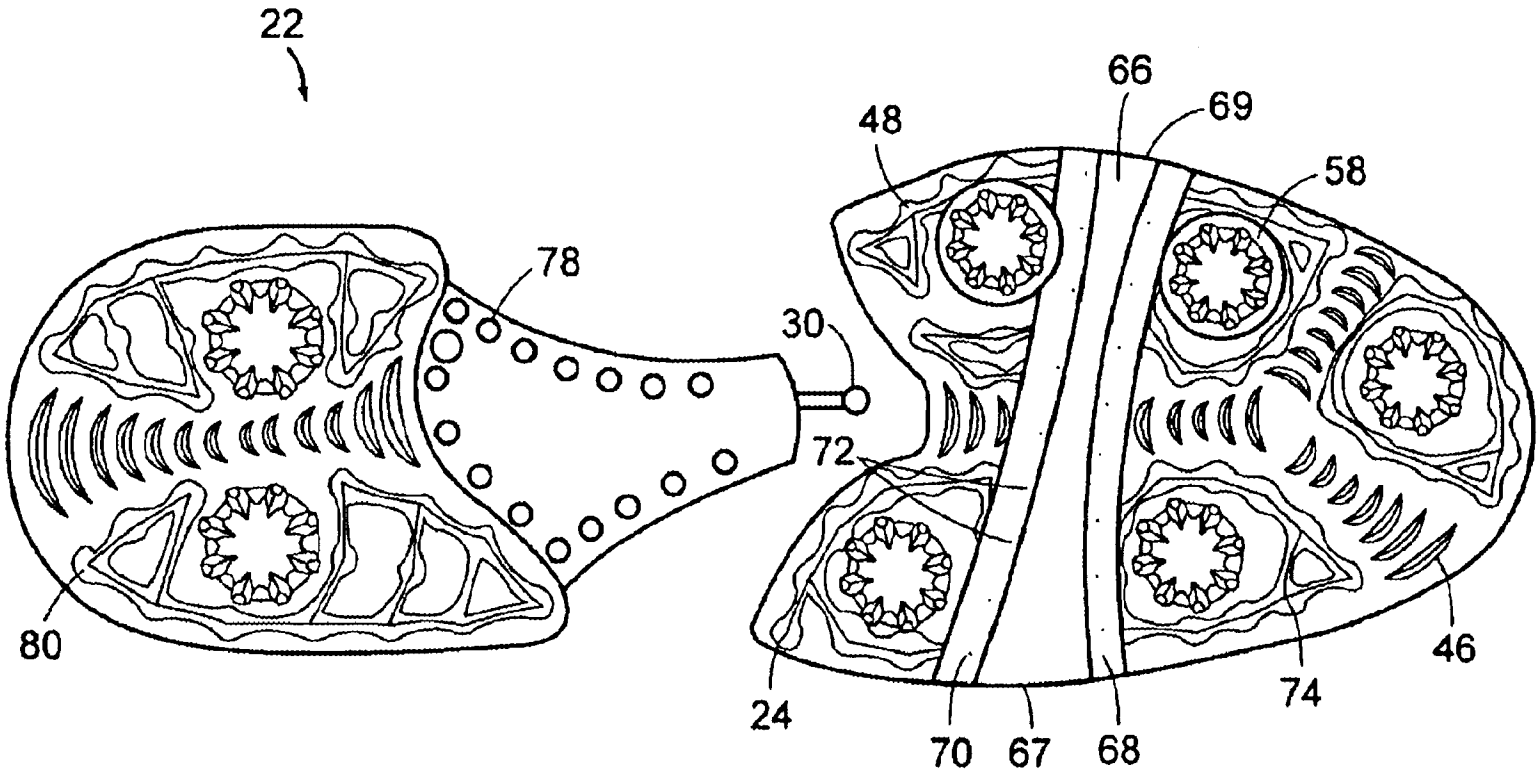
FIG. 5 is a top view of the outsole of FIG. 4.
Figure 7:
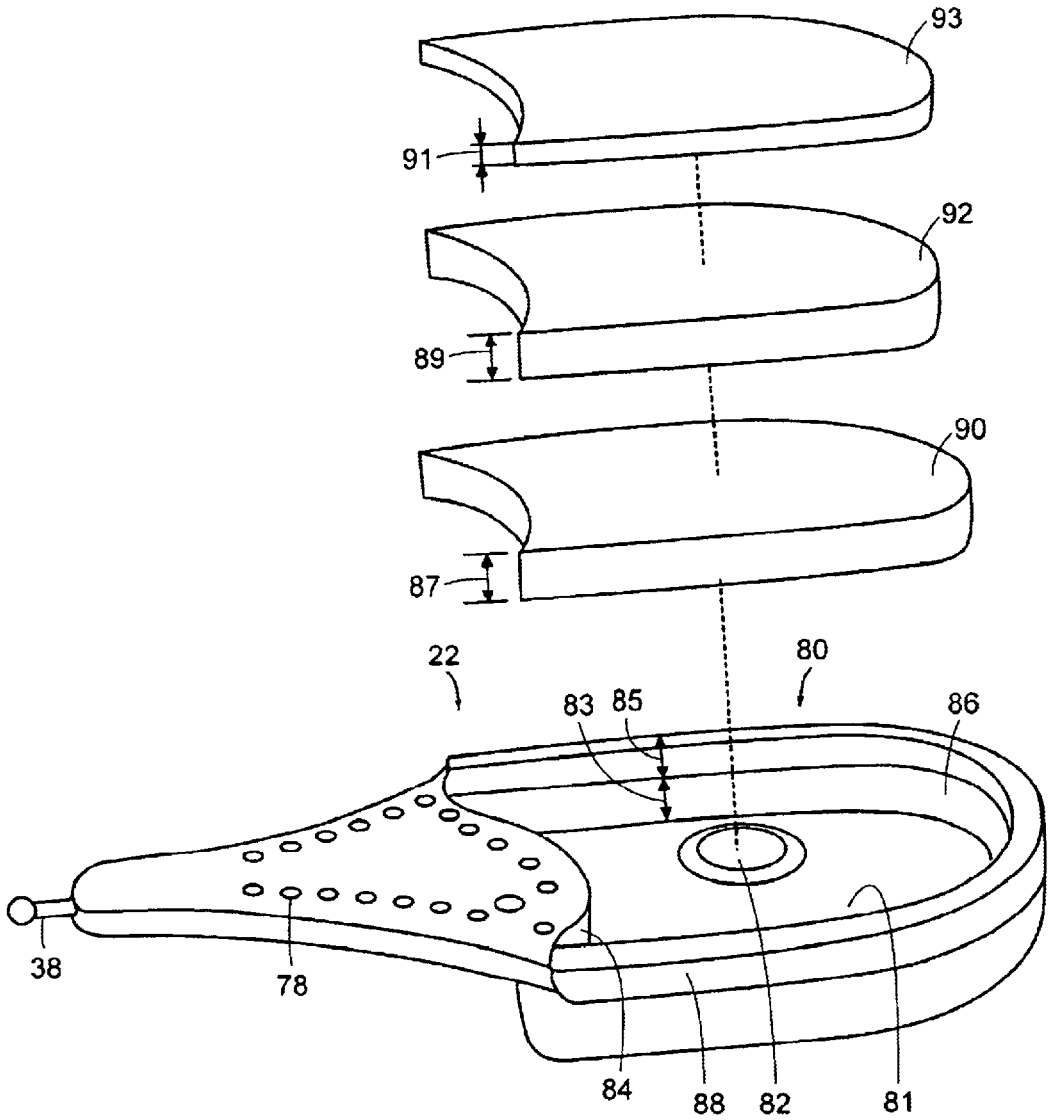
FIG. 7 is an enlarged, partial, perspective view of the rearward portion of outsole of FIG. 4 with a gel cushion and two heel cushions disassembled therefrom.
Figure 9:
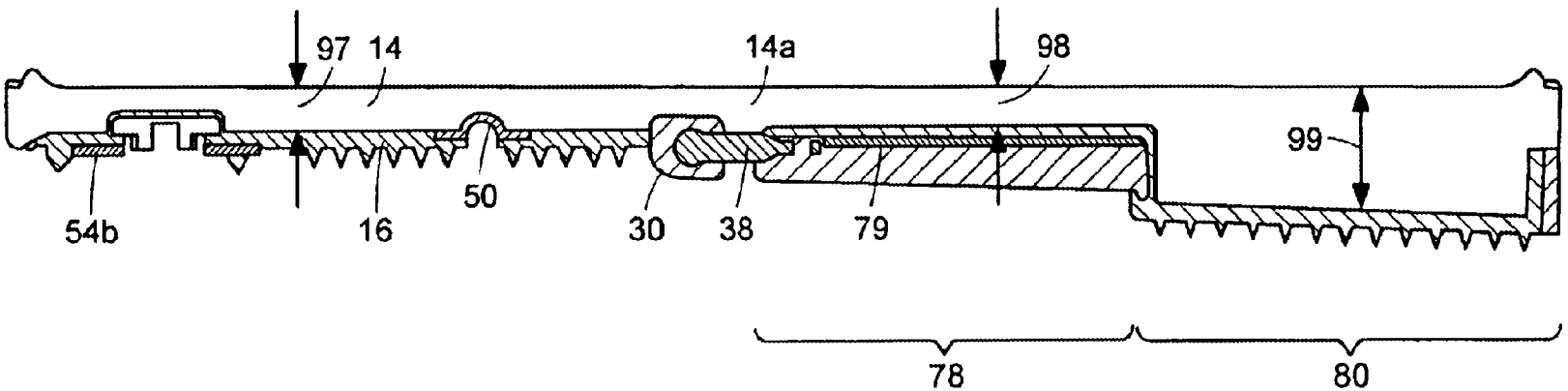
FIG. 9 is a cross-sectional view of the outsole and midsole of FIG. 8 taken along the line I—I.

Referring to FIGS. 5 and 7, the shank-heel piece 22 includes a shank section 78 and a heel section 80. As can be seen in FIG. 9, shank section 78 includes a stiff member 79, preferably embedded within shank section 78, which is positioned to cover a substantial portion of the midfoot. Stiff member 79 is preferably made from a Kevlar® or titanium material, however other stiff material can alternatively be used to have a desirably rigid shank that preferably resists bending. Stiff member 79 does not extend longitudinally into the heel section 80 and allows for the heel to collapse and cushion the wearer's heel during walking. In a preferred embodiment, shank section 78 is trapezoidal in shape having a larger width towards the heel section 80 and narrowing towards the forefoot. During walking and or swinging, the trapezoidal shape of the shank advantageously focuses the torsional forces exerted upon the shank-heel piece 22 toward the ball-and-socket joint and pivot point P. Also, because stiff member 79 is difficult to bend, both transversely and rotationally, shank section 78 preferably transmits substantially all of the torsional forces toward the ball-and-socket joint so that a maximum amount of rotation and bending occurs at a single pivot point P. In alternate embodiments shank sections can be curved, or have other shapes.

Referring to FIG. 2, in one preferred embodiment, the forward portion 20 includes a toe piece 46 and a separate forefoot piece 48. The toe piece 46 and the forefoot piece 48 are connected together by a flexible member 50. The flexible member 50 has a length less than the length of either of the toe piece 46 or the forefoot piece 48. The shank-heel portion 22 in this embodiment is a single piece. However, the present invention is not limited to this construction and alternative embodiments, the forefoot portion 20 can be formed by a single piece.

It is recommended that the flexible member 50 is located such that it will be substantially below the wearer's metatarsal bones. The middle of the flexible member 50 is preferably located directly under the metatarsal heads. This optimally allows for variability of the location of the metatarsal heads by being wider than the flexion axis of the metatarsal heads. As a result, the flexible member 50 forms a hinge and the outsole 16 has good longitudinal flexibility for comfort.

Referring to FIG. 5, the flexible connector 50 that couples the toe piece 46 to the forefoot piece 48 includes a central portion 66, a forward portion 68 and a rearward portion 70. The central portion 66 is formed to arch upward (as best seen in FIG. 6). Preferably, the arched shape of the central portion 66 is formed during molding of the central portion 66. In addition, the central portion 66 may be preferably wider at a lateral edge 67 than at a medial edge 69. The central portion may narrow from each edge 67 and 69 toward the center 71 of the outsole.

The forward portion 68 of the connector 50 overlaps a rear section of the toe piece 46 and is joined thereto preferably during molding. The rearward portion 70 overlaps a front section of the forefoot piece 48 and is joined thereto preferably during molding. In this embodiment, projections 72 formed on the toe and forefoot pieces 46 and 48 extend through the forward and rearward portions 68 and 70 of the connector 50 to insure good adhesion between the connector and the pieces 46 and 48.

Referring to FIGS. 5 and 6, the toe piece 46, forefoot piece 48, and shank-heel portion 22 have similar constructions and preferably include a first or base layer 52 and a second layer formed of discrete exterior or second layer pieces 54*a–c* for toe piece 46. In alternate embodiment, these components may also be a single-layer construction.

The base layer 52 of the outsole 16 forms the inner layer of the outsole and is preferably formed from material that is soft for flexibility in the longitudinal direction. The exterior or second layer pieces 54*a–c* form the outer layer of the outsole that primarily contacts the ground. Preferably, the second layer material is firm for lateral stability. The first or base layer material may be softer than or equal to the exterior or second layer material in hardness.

The outsole 16 of the present invention may be formed by various conventional methods. For example, one recommended method is disclosed in U.S. Pat. No. 5,979,083 to Robinson et al., which is hereby incorporated by reference in its entirety. According to this method, the first and second layers are molded together.

In the embodiment shown in FIG. 5, sockets 58 retain cleat receptacles 60 (best shown in FIG. 4) therein. The receptacles 60 retain the releasable cleats 61 therein. The toe piece 46, forefoot piece 48 and shank-heel portion 22 preferably all include cleat receptacles 60.

Referring again to FIG. 4, the first layer (not shown) further forms sets of projections 62 and 64 that extend therefrom. Sets of projections 62 and 64 are commonly referred to as "spikes" or "cleats," and protrude from the bottom surface of the outsole. These projections 62 and 64 provide traction when the outsole 16 interacts with the ground thereby provide stable support to the golfer especially when the golfer executes a golf shot. These projections 62 and 64 are preferably non-metallic, as most golf courses now require the spikes or cleats in golf shoes to be non-metallic.

The set of projections 62 extend from the layer 52 without contacting another layer, while the set of projections 64 extend from the layer 52 and extend through the second layer pieces 54*a–c*. In this embodiment, the projections in the set of projections 64 are interconnected with one another. Similarly projections 74 formed on the second layer pieces 54*a–c* extend through the first layer 52 to insure good adhesion of these components together.

Preferably, materials for the first or base layer 52 and the second layer pieces 54*a–c* of the toe piece 46, forefoot piece 48 and heel portion 22 have a hardness of at least about 70 Shore A. More preferably, the material hardness is at least about 80 Shore A, and most preferably of about 95±3 Shore A. Suitable materials for the first and second layers include without limitation thermoplastic and thermosetting polymers such as thermoplastic urethanes. A specific material of preference is a thermoplastic urethane, U-95A, manufactured by URE-TECH CO., Ltd. Other applicable thermoplastic urethanes include Desmopan® from Bayer and Pebax® from Atofina.

The flexible member 50 may be formed of a thermoplastic urethane that is substantially softer than the material of the first and second layers for additional flexibility in the forefoot portion 20 (as shown in FIG. 2). Preferably, the flexible member 50 has a hardness of less than about 85 Shore A and more preferably about 70 Shore A. One recommended material is manufactured by URE-TECH CO., Ltd. under the name U-70AP which has a Shore A of about 70±3.

Referring to FIG. 7, the heel section 80 of the shank-heel portion 22 includes a bottom wall 82 that has a generally crescent shape and contains vertically protruding sockets 58. A front wall 84 and a side wall 86 extend vertically from the forward concave edge and the rearward convex edge of the crescent bottom wall 82, respectively. The side wall 86 has a height 83 and a horseshoe shape, and is joined on its topside to a horseshoe member 88 of substantially the same size and width. The horseshoe member 88 has a height 85, and a semi-circular grove fashioned on its outer side; however, the present invention is not limited to this shape. The side wall height 83 and the horseshoe member height 85 combined substantially equal to the height of the front wall 84. The walls 82, 84, 86 and the horseshoe member 88 together define a recess 81. While the shapes of the elements as described above are preferred, one of ordinary skill in the art may readily choose other appropriate shapes.

A first heel cushion 90 is configured and dimensioned to fit within the recess 81. The first heel cushion has a thickness 87 no less than the height of the protruding sockets 58, but no greater than about 5 mm. Preferably, the bottom surface of the first heel cushion 90 is fashioned to compliment the contour of the bottom wall 82, having recesses or through apertures to accommodate the sockets 58. A gel cushion 92 having a thickness 89 is configured and dimensioned to stack on top of the first heel cushion 90 and fit within the recess 81. Preferably, the gel cushion thickness is at least about 3 mm, more preferably at least about 5 mm, and most preferably at least about 7 mm. The gel cushion 92 may have a plurality of small vertical through apertures to provide extra cushioning effect. A second heel cushion 93 having a thickness 91 no greater than about 5 mm is configured and dimensioned to stack on top of the gel cushion 92 and fit within the recess 81. When assembled, the first heel cushion 90, the gel cushion 92, and the second heel cushion 93 are stacked vertically in that order from bottom to top, filling up substantially the entire recess 81. Optionally, adhesives may be used to bond the cushions to each other, and to the walls 82, 84 and 86. The thicknesses 87, 89 and 91 in combination substantially equal to the height of front wall 84, as well as to the combined heights 83 and 85. As a result, the cushions 90, 92 and 93 are disposed substantially below the wearer's calcaneus bone. In another embodiment, the first and/or second heel cushion 90, and the gel cushion 92 substantially fills the recess 81. The bottom surface of the gel cushion 92 may be fashioned to conform to the contour of the bottom wall 82 that includes the protruding sockets 58.

To achieve satisfactory cushioning effect, the heel section 80 comprising the cushions 90, 92 and 93 preferably has a cushioning factor of at least about 1.18, more preferably at least about 1.2, and most preferably at least about 1.25. The term "cushioning factor" is defined as a ratio of a time to peak g over a peak g value, both parameters being measured with a computerized impact testing system (CompITS, Exeter Research, Brentwood, N.H.). The CompITS is a falling weight impact machine designed to test heel and forefoot regions of whole, intact athletic shoe cushioning system in conformance with ASTM F1976-99, titled "Standard Test Method for Cushioning Properties of Athletic Shoes Using an Impact Test," as well as to test midsole in conformance with ASTM F1614-99, titled "Standard Test Method for Shock Attenuating Properties of Materials Systems for Athletic Footwear." The impact tester uses a shaft and a missile head with a combined drop mass of 8.5 kg dropping from a height of 5 cm onto the heel section 80. A computer interface controls the number of drops and samples data from a linear variable transducer and a Kistler accelerometer at 1,000 Hz via an analog-to-digital converter. In the context of the human/footwear system, the impact tester is intended to mimic the foot hitting the ground during foot strike. As the missile head drops into the heel section 80, its motion slows down due to the cushion materials. This deceleration, measured in g (gravity) force, is plotted against time in milliseconds to generate a curve with a peak, from which the peak g and the time to peak g value are determined. The heel section 80 of each sample is subjected to 25 preliminary drops, immediately followed by 30 test drops. Data are recorded during each of the test drops, means in peak g value and time to peak g are generated to calculate the cushioning factor.

The first and second heel cushions 90 and 93 are formed of a cushioning material such as EVA, but are not limited thereto and other materials or constructions such as foam, air cushions, and the like can be used. Preferably, the second heel cushion 93 is fashioned into the midsole 14 as a raised layer. This eliminates an extra component during fabrication and assembly, thereby reducing manufacturing cost and production time. In the preferred embodiment, the horseshoe member 88 is formed of a thermoplastic urethane having a hardness of at least about 70 Shore A and comprising a pigment of a contrasting color such as white and silver. The pigment allows the display of the horseshoe member 88 to be more prominent, and makes the heel section 80 more aesthetically pleasing. In an alternative embodiment, the horseshoe member 88 is formed of a clear or opaque thermoplastic urethane, so that when assembled, portions of the gel cushion 92 is visible through the member 88. Preferably, the member 88 is made from the UTY-90A material mentioned above.

The gel cushion 92 may be continuous or discontinuous, optionally have adhesive properties, be crosslinked, and further comprise additives such as fibrous and/or particulate materials, curing agents, crosslinking agents, fillers, colorants, processing aids, antioxidants, foaming agents, blowing agents, plasticizers, and mixtures thereof. The material for the gel cushion 92 preferably has vibration damping properties, and is typically a viscoelastic material. Suitable viscoelastic materials for the present invention include, but are not limited to, triblock copolymers; diblock copolymers; thermoplastic elastomers; thermoplastic olefins; thermoplastic vulcanates; thermoplastic urethanes; vinyl copolymers; polyvinyl acetate and copolymers thereof; acrylics; polyesters; polyurethanes; polyethers; polyamides; polybutadienes; polystyrenes; polyisoprenes; polyethylenes; polyolefins; polyvinyl butyral; epoxy-acrylate interpenetrating networks; natural and synthetic rubbers; silicon rubbers; nitrile rubbers; butyl rubbers; piezoelectric ceramics; foamed polymers; ionomers; low-density fiber glass; bitumen; air bladders; liquid bladders; and mixtures thereof. Piezoelectric ceramics particularly allow for specific vibration frequencies to be targeted and selectively damped electronically. Commercially available viscoelastic materials include GP-815G from Dioshy Co., Ltd., Kraton™ from Shell Chemical, Scotchdamp™ from 3M, Sorbothane® from Sorbothane, Inc., Dynamat® from Dynamat Control of North America, Inc., NoViFleX™ Sylomer® from Pole Star Maritime Group, LLC, and Legetolex™ from Piqua Technologies, Inc., among others.

Another group of suitable viscoelastic materials is low-density granular materials that when coupled to structures for the purpose of reducing structural vibrations, provide a concomitant attenuation in airborne acoustic noises radiated from the structure. Such low-density granular materials including without limitation perlite; vermiculite; polyethylene beads; glass microspheres; expanded polystyrene; nylon flock; ceramics; polymeric elastomers; rubbers; dendritic particles; and mixtures thereof. Technology associated with the use of these low-density granular materials for damping structural vibrations is described by the trademark name Lodengraf™.

In the preferred embodiment, the viscoelastic material for the gel cushion has a material hardness of no greater than about 25 Shore A, preferably no greater than about 20 Shore A. A specifically material of preference is GP-815G from Dioshy Co., Ltd. GP-815G comprises a saturated styrene-ethylene/butylene-styrene triblock copolymer, sold under the trade name Kraton™ G1651 by Shell Chemical. Certain physical properties of GP-815G are listed in Table I below. GP-815G is further blended with a blowing agent such as MagicBall® ESD-305 from Engrave Stone, Co., Ltd. Preferably, the blowing agent is added in an amount of at least about 2 percent by weight of the viscoelastic material. More preferably, the weight percentage of the blowing agent is from about 4 percent to about 10.0 percent, and most preferably, about 5 percent or about 6 percent, by weight of the viscoelastic material.

TABLE I

Physical Properties of GP-815G from Dioshy Co., Ltd.

| Properties | Unit | Test Standard | Result |
|---|---|---|---|
| Density | g3 | ASTM D297 | 0.935 |
| Melt Index | g/10 min | 190° C. (E)/2.16 kg | 69 |
| Hardness | Shore A | JIS K6301 | 16 |
| Tensile Strength | $Kg/cm^2$ | JIS K6301 | 20 |
| Tear Strength | Kg/cm | JIS K6301 | 11 |
| Elongation | % | JIS K6301 | 757 |
| 300% Modulus | $Kg/cm^2$ | JIS K6301 | 1 |

Figure 8:
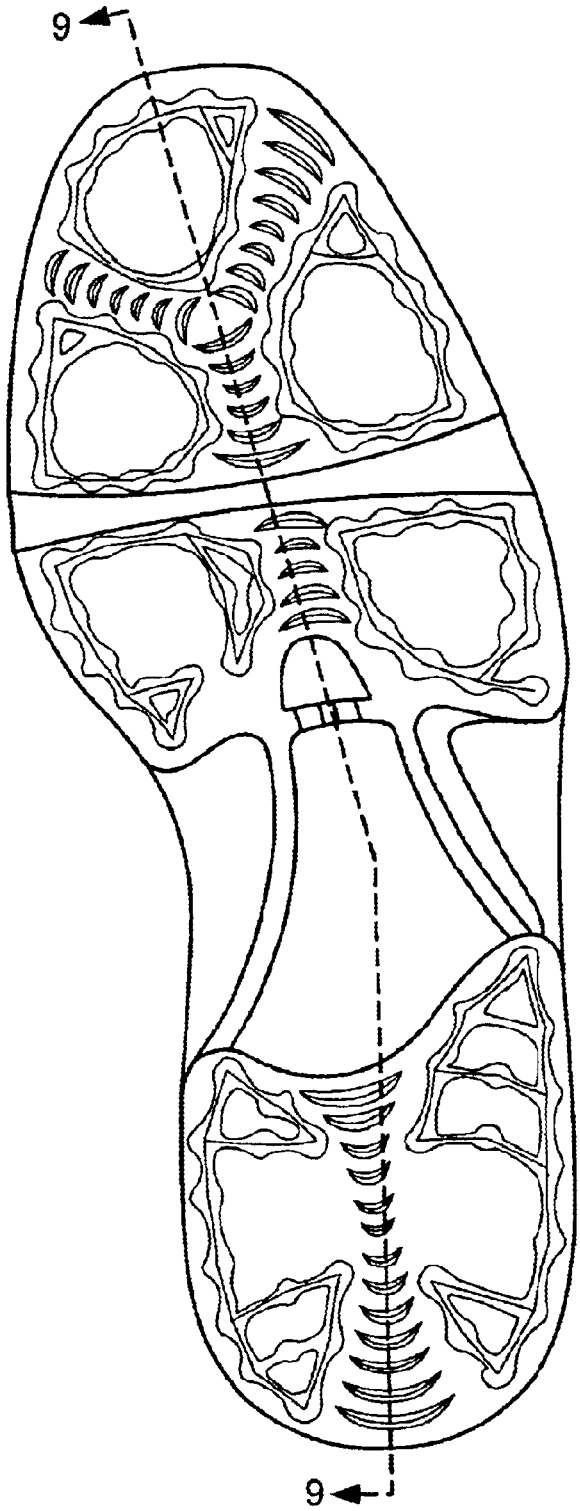
FIG. 8 is a bottom view of the outsole of FIG. 4, with the spikes disassembled therefrom, joined to a midsole of the golf shoe of FIG. 1.

Referring to FIGS. 8 and 9, the outsole 16 can be joined to the midsole 14 via a cementing process or molding process. The midsole 14 has a section 14*a* adjacent the shank section 78 that must be formed sufficiently bendable to allow the portions 20 and 22 to move with respect to one another. This is achievable by varying the thickness of the midsole. The portion of the midsole 14 that is adjacent the front portion 20 has a first thickness 97. The portion of the midsole 14 that is adjacent the shank section 78 has a second thickness 98. The portion of the midsole 14 that is adjacent the heel section 80 has a third thickness 99. Preferably, the first and third thickness 97 and 99 are substantially greater than the second thickness 98. More preferably, the first thickness 97 is about 12–14 mm, the second thickness 98 is about 5–7 mm and the third thickness 99 is about 9–11 mm. The midsole 14 when joined to the outsole 16 overlies the top surface 24 (as shown in FIG. 5) and the upper surface of the gel cushion 92 (as shown in FIG. 7). Alternatively, the midsole can be bendable adjacent the shank due to selecting a material with the proper characteristics.

Figure 10:
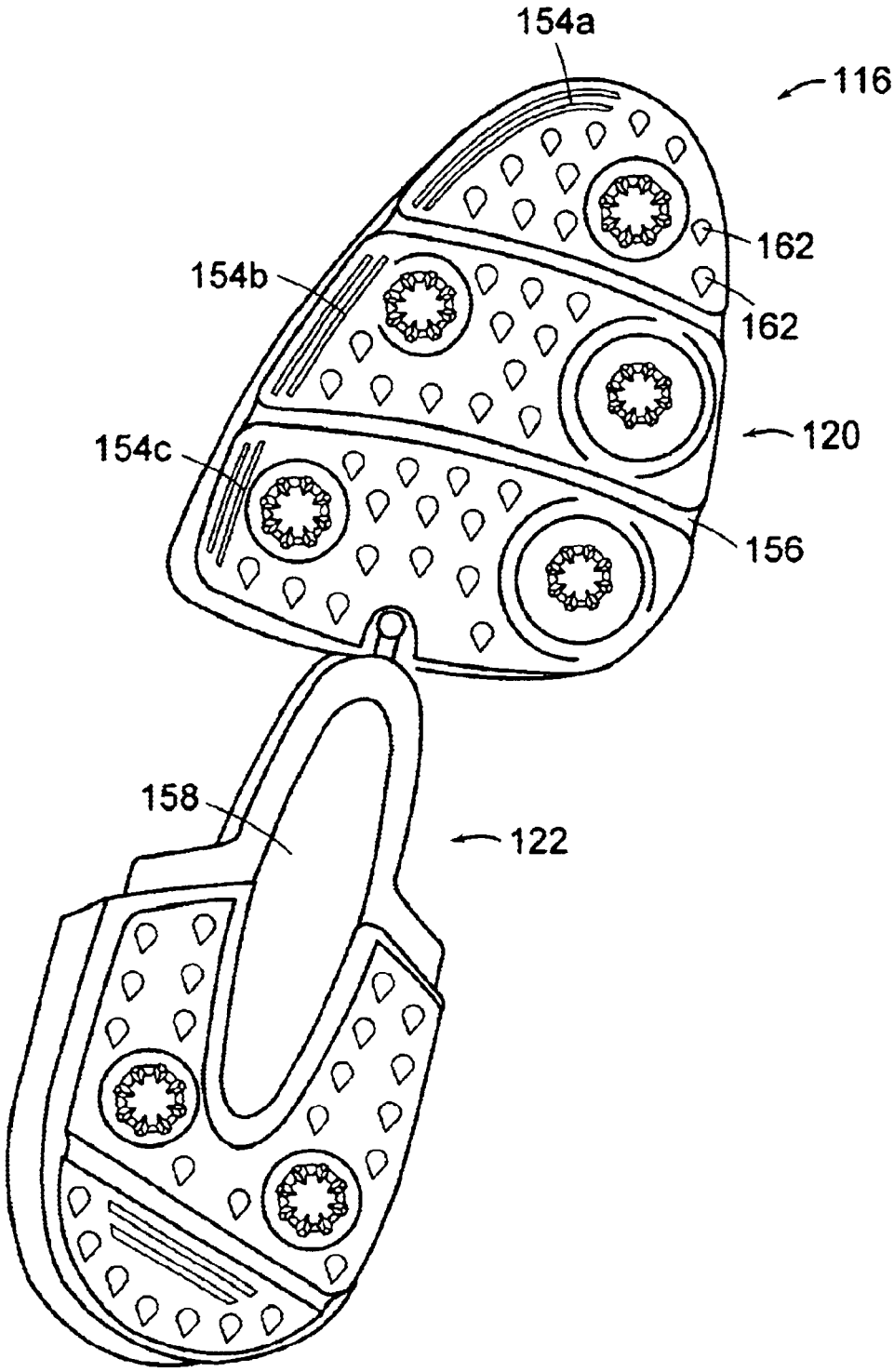
FIG. 10 is a bottom view of a second embodiment of an outsole of the present invention joined to a midsole.

Referring to FIG. 10, an alternative embodiment of an outsole 116 is shown connected to midsole 14. Outsole 116 is similar to outsole 16 previously discussed and operates similarly. Outsole 116 is formed with a forward portion 120 and rearward portion 122 connected similarly to outsole 16. Forward portion 120, however, is formed of three first layer pieces 154*a–c* that are connected to one another by a second layer 156. Portions of the second layer 156 extend through the pieces 154*a–c* to form projections 162.

A logo assembly 158 is positioned along a portion of outsole 116 and includes a transparent layer material to protect the logo when the outsole contacts the ground and permit visibility of the logo. One preferred material for the logo assembly 56 is an ester-based thermoplastic polyurethane manufactured by URE-TECH CO., Ltd. under the name UTY-90A, having a Shore A of about 90.

Figure 11:
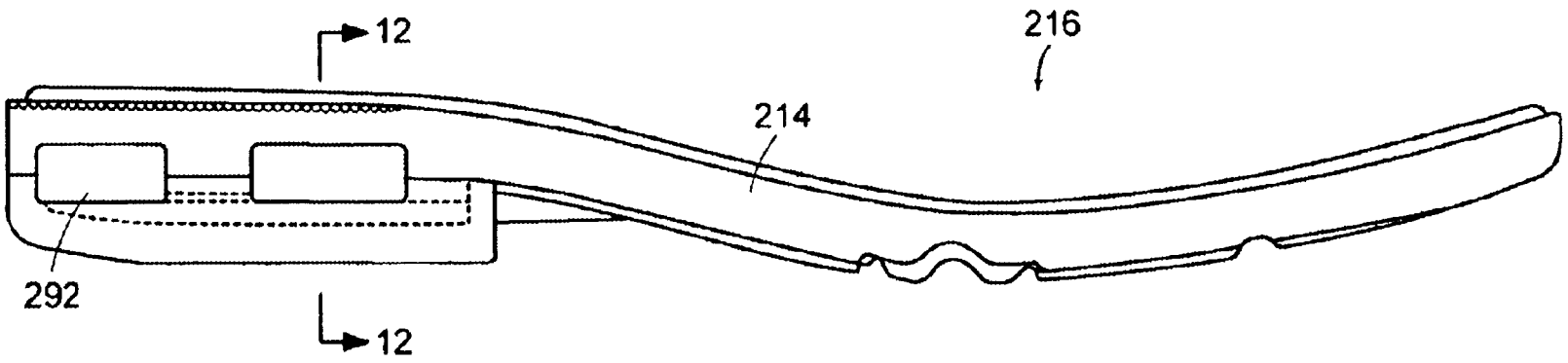
FIG. 11 is a side view of another embodiment of a gel cushion joined to an outsole and midsole of the present invention.
Figure 12:
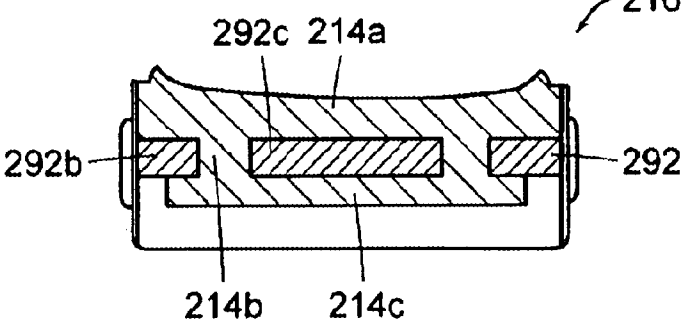
FIG. 12 is a cross-sectional view of the gel cushion, outsole and midsole along line II—II of FIG. 11.
Figure 13:
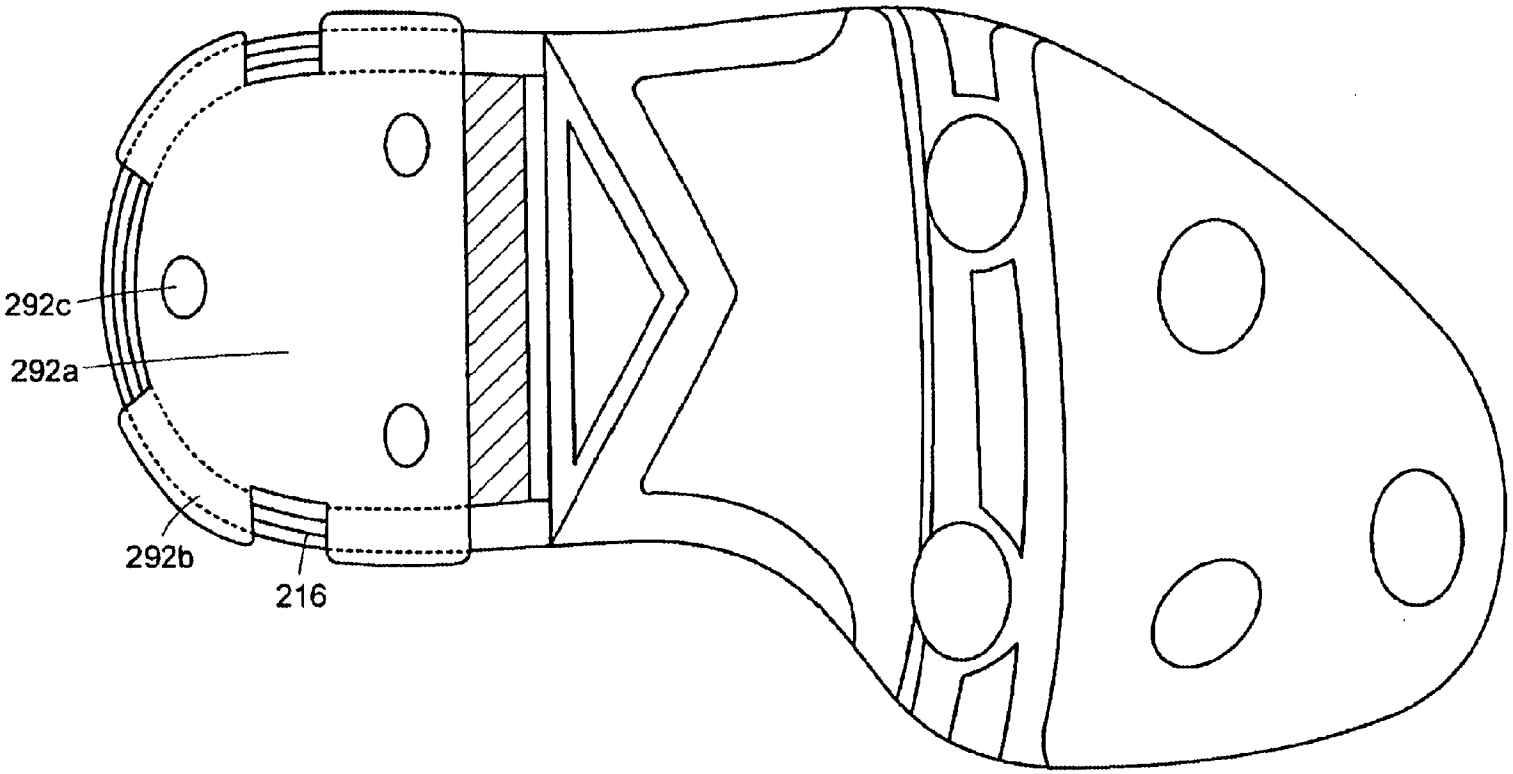
FIG. 13 is a top view of the gel cushion, outsole and midsole of FIG. 11.

Referring to FIGS. 11–13, an alternative construction of an outsole 216 is shown. Outsole 216 may include the ball-and-socket feature of outsoles 16 or 116 discussed above and operate similarly. Outsole 216 includes a gel cushion 292. Cushion 292 includes a central portion 292*a* (best seen in FIG. 13) that is configured and dimensioned so that it is disposed within the recess 86 (as shown in FIG. 5) under the midsole portion 214*a*.

The gel cushion 292 further includes extensions 292*b* that extend from the central portion 292*a* beyond the midsole 214 and outsole 216 (as best seen in FIG. 12) so that they are visible from the exterior of the shoe. Although four extensions 292*b* are shown, the number and geometry of the extensions can vary in another embodiment.

The gel cushion 292 further includes three apertures 292*c* in the main body portion 292*a*. In addition, the number and geometry of the apertures 292*c* can vary in another embodiment. As shown in FIG. 12, when the midsole 214 is molded to the outsole 216 and gel cushion 292, the midsole portion 214*b* extends through the apertures 292*c* of the cushion and portion 214*a* of the midsole is above the gel cushion 292, and portion 214*c* is below the gel cushion 292.

While it is apparent that the invention herein disclosed is well calculated to fulfill the objects above stated, it will be appreciated that modifications and embodiments may be devised by those skilled in the art. For example, other types of connections, such as latches or clamps may also be used in place of the ball-and-socket connection to provide independent and relative movement of the forefoot and shank-heel portions. The outsoles 16, 116 and 216, and features thereof discussed above may be used with other types of shoes, not just golf shoes. The flexible member can be used with shoes with other constructions and particularly golf shoes with or without the ball-and-socket connection. In addition, the gel cushions can be used with shoes with other constructions and particularly golf shoes with or without the ball-and-socket connection. The appended claims cover all such modifications and embodiments as fall within the true spirit and scope of the present invention. The present invention is further illustrated in the following non-limiting examples.

EXAMPLES

Whole, intact sample golf shoes under the trademark GelFusion™ was constructed, using the materials of the present invention under the trademark of GelRide™ in their heel sections. These sample shoes were compared with commercially available golf shoes under the names of DryI.C.E. ™ and DryJoys® in their cushioning properties according to ASTM F1976-99, using the CompITS impact tester as described above. Primary parameters, specifically the peak g value and the time to peak g, were recorded. Secondary parameter, namely the cushioning factor as defined above, was calculated. These parameters in particular reflect the cushioning effect of the material systems within the heel sections of the golf shoes. In general, the smaller the peak g value and the longer the time to peak g are, the larger the cushioning factor becomes, and the more cushioning effect the materials provide to the heel section. Results of the test are tabulated as follows.

TABLE II

Cushioning Effect of Materials in Heel Sections of Golf Shoe Samples

| Golf Shoes | Peak g Value (g) | Time to Peak g (ms) | Cushioning Factor |
|---|---|---|---|
| GelFusion ™ | 9.72 | 12.75 | 1.312 |
| DryI.C.E. ™ | 9.75 | 11.25 | 1.154 |
| DryJoys ® | 10.33 | 10.0 | 0.968 |

As the data in Table II indicate, heel sections of GelFusion™ shoes comprising the GelRide™ material have a smaller peak g value, a longer time to peak g, and a larger cushioning factor than those of DryI.C.E.™ and DryJoys®. Specifically, the GelFusion™ is 0.3% less in peak g value, 12.7% longer in time to peak g and 13.7% greater in cushioning factor than the DryI.C.E.™, while 5.9% less in peak g value, 27.0% longer in time to peak g and 35.5% greater in cushioning factor than the DryJoys®. Therefore, the GelFusion™ shoes with the GelRide™ material has the best cushioning effect in the heel section.

What is claimed is:

1. A shoe comprising an upper and a sole, wherein:

the sole comprises a heel portion;

the heel portion comprises an outsole forming a recess and plurality of cushion members comprised of a first heel cushion, a second heel cushion and a gel cushion therebetween, the cushion members substantially filling said recess;

the first cushion having a first thickness of no greater than 5 mm, the second cushion member having a second thickness of no greater than 5 mm and the gel cushion having a third thickness of at least 7 mm, and the heel portion has a cushioning factor of at least about 1.18.

2. The shoe of claim 1, wherein the cushioning factor of the heel portion is at least about 1.2.

3. The shoe of claim 2, wherein the cushioning factor of the heel portion is at least about 1.25.

4. The shoe of claim 1, wherein the gel cushion has a hardness of no greater than about 25 Shore A.

5. The shoe of claim 4, wherein the hardness of the gel cushion is no greater than about 20 Shore A.

6. The shoe of claim 1, wherein the gel cushion comprises a vibration damping viscoelastic material.

7. The shoe of claim 6, wherein the viscoelastic material is a material selected from the group consisting of triblock copolymers; diblock copolymers; thermoplastic elastomers; thermoplastic olefins; thermoplastic vulcanates; thermoplastic urethanes; vinyl copolymers; polyvinyl acetate and copolymers thereof; acrylics; polyesters; polyurethanes; polyethers; polyamides; polybutadienes; polystyrenes; polyisoprenes; polyethylenes; polyolefins; polyvinyl butyral; epoxy-acrylate interpenetrating networks; natural and synthetic rubbers; silicon rubbers; nitrile rubbers; butyl rubbers; low-density granular materials; piezoelectric ceramics; foamed polymers; ionomers; low-density fiber glass; bitumen; air bladders; liquid bladders; or mixtures thereof.

8. The shoe of claim 6, wherein the viscoelastic material further comprises fibrous materials, particulate materials, curing agents, crosslinking agents, fillers, colorants, processing aids, antioxidants, foaming agents, blowing agents, plasticizers, or mixtures thereof.

9. The shoe of claim 8, wherein the viscoelatic material includes a blowing agent in an amount of at least about 2 percent by weight of the viscoelastic material.

10. The shoe of claim 9, wherein the amount of the blowing agent is from about 4 percent to about 10 percent by weight of the viscoelastic material.

11. The shoe of claim 1, wherein the gel cushion comprises a saturated styrene-ethylene/butylene-styrene triblock copolymer and a blowing agent.

12. The shoe of claim 1, wherein the outsole comprises a material having a hardness of at least about 70 Shore A.

13. The shoe of claim 12, wherein the material of the outsole has a hardness of at least about 80 Shore A.

14. A shoe comprising an upper and a sole having a heel portion, wherein:

the heel portion comprises an outsole forming a recess in the heel portion and a midsole;

a gel cushion is disposed between the outsole and the midsole and being located within said recess;

the gel cushion comprises a viscoelastic material and is at least 7 mm thick; and the heel portion has a cushioning factor of at least about 1.18.

15. A shoe comprising an upper and a sole having a heel portion, wherein:

the heel portion comprises an outsole and a gel cushion;

the gel cushion comprises a triblock copolymer and a blowing agent; and the heel portion has a cushioning factor of at least about 1.2.

* * * * *